United States Patent [19]

Grimbly

[11] Patent Number: 4,627,651

[45] Date of Patent: Dec. 9, 1986

[54] SAFETY LOCKING DEVICE FOR DOORS

[76] Inventor: Robert H. Grimbly, 337 Upper Ottawa Street, Hamilton, Ontario, Canada, L8T 3S5

[21] Appl. No.: 844,247

[22] Filed: Mar. 24, 1986

Related U.S. Application Data

[63] Continuation of Ser. No. 654,714, Sep. 27, 1984, abandoned.

[51] Int. Cl.[4] ..... E05C 19/18

[52] U.S. Cl. ..... 292/288; 70/450; 292/302; 292/341.15

[58] Field of Search ..... 292/288, 302, 150, 189, 292/341.15; 70/450

[56] References Cited

U.S. PATENT DOCUMENTS

| | | | |
|---|---|---|---|
| 557,602 | 4/1896 | Pletcher et al. . | |
| 1,262,054 | 4/1918 | Johnson et al. | 292/302 |
| 1,351,117 | 8/1920 | Newhall . | |
| 1,364,757 | 1/1921 | Herrman | 292/341.15 |
| 1,564,715 | 12/1925 | Russell | 292/302 |
| 1,659,822 | 2/1928 | Innes . | |
| 2,726,112 | 12/1955 | Conhagen . | |
| 2,790,992 | 5/1957 | Campbell . | |
| 3,206,793 | 9/1965 | Silverberg | 292/288 |
| 3,663,989 | 5/1972 | Ellard | 292/302 X |
| 3,806,176 | 4/1974 | Massie | 292/341.15 X |
| 3,951,443 | 4/1976 | Barnaby | 292/302 X |
| 4,013,311 | 3/1977 | Prezioso | 292/302 X |
| 4,015,868 | 4/1977 | Buttler | 292/302 |
| 4,379,577 | 4/1983 | Robertson | 292/341.15 |
| 4,482,177 | 11/1984 | Nagy | 292/341.15 X |

FOREIGN PATENT DOCUMENTS

| | | | |
|---|---|---|---|
| 13676 | 5/1911 | France | 292/341.15 |

*Primary Examiner*—Gary L. Smith
*Assistant Examiner*—Lloyd A. Gall
*Attorney, Agent, or Firm*—Hirons, Rogers & Scott

[57] ABSTRACT

A door safety device consists of cooperating strike plate and face plate portions corresponding respectively to the strike plate and face plate of a conventional door lock or passage set. These portions are provided with apertures which when installed at the location of the door bolt permit the passage of the door bolt therethrough; they are also provided with cooperating portions projecting into the room that with the door closed register with one another and provide registering passages for reception of a lock pin that joins them securely together. The two portions can replace the strike and face plates of an existing lock and utilize the existing recesses and screw holes so that installation is possible with only the use of a screwdriver. At least the face plate portion can be installed over the existing face plate instead of replacing it, but this usually is not preferred with the strike plate portion due to space and operating considerations. The device can also be sold as an integral part of a door lock or passage set. In the case of a door with more than one bolt the device should be installed as centrally as possible of the length of the door.

2 Claims, 3 Drawing Figures

SAFETY LOCKING DEVICE FOR DOORS

This application is a continuation of application Ser. No. 654,714, filed Sept. 27, 1984, now abandoned.

FIELD OF THE INVENTION

This invention relates to a safety locking device for doors, particularly to such a device that is readily applicable to an already installed door.

REVIEW OF THE PRIOR ART

The provision of adequate safety locking devices for doors has always been of concern to householders and is becoming increasingly so. There has always been the desire for devices that need only be applied from inside the door, so as to provide security additional to the conventional door lock while indoors and perhaps sleeping, and those principally in use at this time are the surface-mounted standard slide bar bolt and chain lock. Both of these devices have the disadvantages that the door and the adjacent jamb must both be drilled to receive the fastening screws, and sometimes in addition the surrounding door molding must be slotted to receive the respective part. This constitutes an unsightly marring and cluttering of the face of the door and the surrounding door trim, which nevertheless is accepted because of the paramount desire for safety. In addition such devices are often not effective since, if force is applied to the door to open it, e.g. by body pressure, this force acts in the direction to pull the fastenings directly out of the wall and/or the door; if the fastenings are at all insecure and/or sufficient force is applied they will give way and the door will open.

It has been proposed hitherto to use for this purpose a door butt hinge which is installed on the edge of the door that moves outwards as it opens. The hinge pin is provided with an enlarged head, or otherwise made easily graspable by the hand for ready removal and replacement. With the connecting pin installed in this "additional" hinge the door is firmly closed and any force applied to open it is delivered to the hinge fastenings as a shear force, to which they are very much more highly resistant than a direct pull as described above. Moreover, there is no locking mechanism that can be picked or pried open with a tool. For example, it has been proposed in U.S. Pat. No. 1,659,822, issued Feb. 21, 1928 to H. C. Innes to use such a butt hinge for latching windows. Another form of such device for latching doors is described in U.S. Pat. No. 4,015,868, issued Apr. 5, 1977 to Carl T. Buttler, the principal feature being a provision to ensure that the connecting pin is not lost. Both of these devices require special installation in recesses in the door edge and door frame by a carpenter, or someone having the necessary carpentry skill, which makes them expensive or relatively difficult to install, and therefore operates against their adoption by the cost-conscious general public in favor of the less secure but more easily installed devices described above.

DEFINITION OF THE INVENTION

It is therefore the object of the present invention to provide a new safety locking device for doors which is readily installable thereon.

In accordance with the invention there is provided a safety device for application to the vertical edge of a door and the adjacent vertical edge of a surrounding door frame comprising:

a thin strike plate portion replaceable for or installable over the existing door frame edge strike plate of a door lock or passage set having a lock bolt, the portion having an aperture therein for the passage of the lock bolt and apertures therein for the passage of fastening means for fastening the portion to the said door frame vertical edge, the portion providing at least one respective connecting lock pin receiving passage which when the portion is in position on the door frame edge will project beyond the door frame edge;

a thin face plate portion replaceable for or installable over the existing door edge face plate of the door lock or passage set, the portion having an aperture therein for the passage of the lock bolt and apertures therein for the passage of fastening means for fastening the portion to the said door vertical edge, the portion providing at least one respective connecting lock pin receiving passage which when the portion is in position on the door edge will project beyond the door edge and be registrable with the door closed with the said pin receiving passage of the strike plate portion; and a connecting lock pin insertable in the registered pin receiving passages of the said two portions to connect them together and thereby hold the door closed.

Such a device can easily be installed even by persons of relatively little skill, for example, simply by removing the existing strike and face plates and replacing them with the respective portions of the safety device; such an operation requires only the use of a screwdriver, since the required recesses were provided when the lock was installed. It may be possible with some forms of lock to install the strike and face plate portions of the device over the existing lock strike and face plates, perhaps using longer screws to compensate for the thickness of the added plates. However, it is unlikely that in most existing installations there will be sufficient space between the door edge and door frame to accommodate both portions of the device as an addition, and if there is room for only one then it is preferred to replace the existing strike plate and install the device face plate portion over the existing door face plate.

DESCRIPTION OF THE DRAWINGS

A particular preferred embodiment of the invention will now be described, by way of example, with reference to the accompanying diagrammatic drawings, wherein.

DESCRIPTION OF THE PREFERRED EMBODIMENTS

Figure 1:
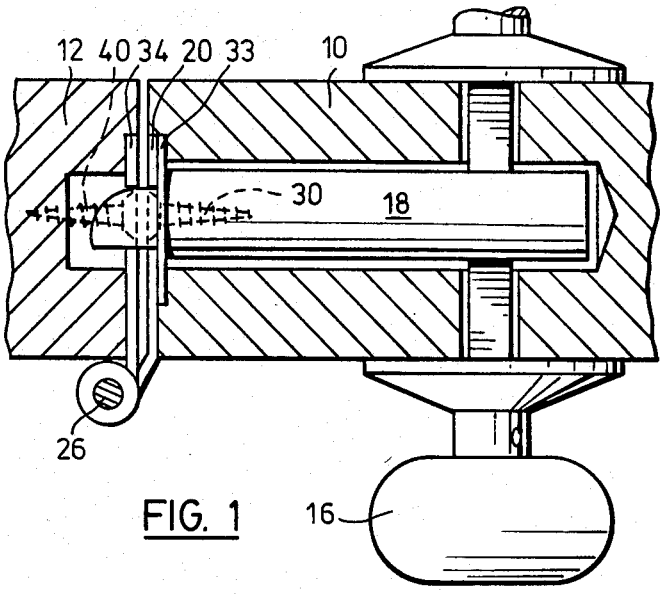
FIG. 1 is a horizontal section through the edge of a door and the adjacent edge of the associated door frame to show the inter-relation between the device of the invention and a lock or passage set.
Figure 2:
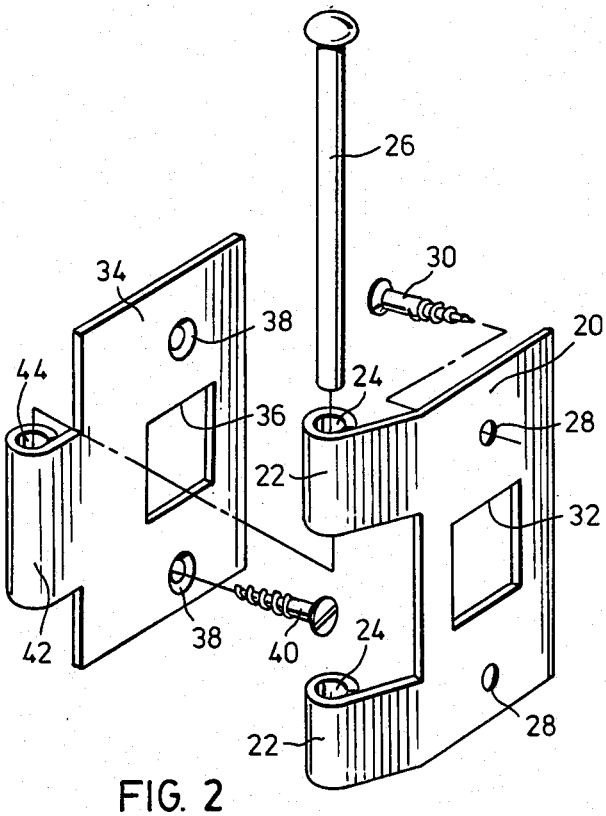
FIG. 2 is an exploded view of the device per se.
Figure 3:
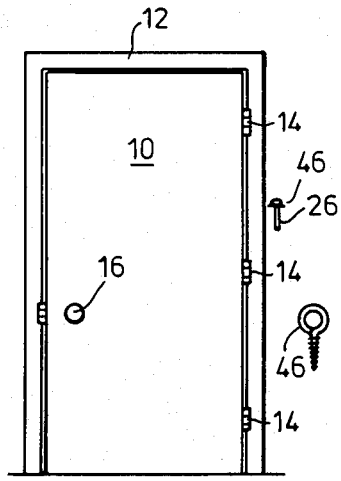
FIG. 3 is a front elevation of a door with the device of the invention installed.

A door 10 is installed in a door frame 12 by means of conventional hinges 14. A door knob 16 projecting from an outer door face controls the movement of a lock bolt 18 of a door lock or passage set into and out of the recess provided for it in the door frame. If already installed the lock will have a face plate installed in a respective recess in the edge of the door and a strike plate installed in a respective recess in the facing edge of the door frame, and one or both of these may need to be replaced.

The device of the invention consists of a face plate portion 20 which is as closely as possible of the same size and configuration as the existing face plate but having extending therefrom to the interior of the room two spaced lock pin receiving portions 22, which provide vertically registering passages 24 for reception of the lock pin 26. The face plate portion is provided with two countersunk screw-receiving apertures 28 to receive the existing screw fasteners 30 (only one shown) of the existing face place, and with the usual face plate aperture 32 to permit free movement of the lock bolt therethrough. If there is sufficient room the face plate can be installed over the existing face plate 33 (as illustrated in FIG. 1), using somewhat longer screws 30 to compensate for the added thickness, and this may be necessary to ensure the required registry between the two cooperating parts of the device.

A strike plate portion 34 is also provided with a bolt-receiving aperture 36 and countersunk screw-receiving apertures 38 for reception of fastening screws 40 (only one shown). This strike plate portion has extending from an outer frame face into the interior of the room a single lock pin receiving portion 42 that with the door closed, is interposed between the two spaced lock pin receiving portions 22 of the face plate portion, this portion 42 providing a lock pin receiving passage 44 that can register with the passages 24 for reception of the lock pin 26. The pin receiving portion 42 also functions as the strike plate to receive and guide the lock bolt 18 as the door is closed. When not in use to secure the door the pin 26 is stored in a holder 46 attached to the door frame. It will usually be preferred to replace the existing strike plate with the strike plate portion of the invention, the installation over the existing strike plate normally not being possible because of lack of space between the door and frame and because of the need to ensure good strike action.

It will be seen that the device of the invention is easily installed, usually requiring only the use of a suitable screwdriver, and when installed is relatively inconspicuous, but nevertheless is very secure since the force to open the door is applied in shear to the screws 30 and 40. The device is also relatively inexpensive to manufacture in that its basic configuration is essentially the same as a standard butt hinge.

The device can be included in new locks or passage sets as an integral part thereof with relatively little increase in the cost of manufacture. Although in this embodiment the strike plate portion has only one protruding portion 42 it can provide more such portions with respective passages 44, provided that the requirement is met for a central portion to provide adequate strike plate action. The face plate portion can have a single protruding portion or more than two such portions. In practice the gap that exists between a door and the adjacent frame edge varies widely, but it is found to be a simple matter after installation to bend one or both of the parts the small amount required to obtain sufficicient registry between the pin-receiving passages. Some doors, particularly older doors may have more than one bolt and the device preferably is installed as close as possible to the center of the door at or just above the handle.

I claim:

1. The combination of a safety device with a door and its surrounding door frame and with a door lock or passage set mounted on the door and the frame and having a door frame edge strike plate, a door face plate and a lock bolt for holding the door closed in the frame, the safety device being fastened to the vertical opening edge of the door and the adjacent vertical edge of the frame, the safety device comprising:

a thin strike plate portion replacing or installed over the strike plate of the door lock or passage set, the strike plate portion having an aperture therein through which the lock bolt passes and apertures therein through which pass fastening means fastening the portion to the said door frame vertical edge, the portion providing at least one respective connecting lock pin receiving passage projecting beyond the door frame outer face;

a thin face plate portion replacing or installed over the face plate of the door lock or passage set, the face plate portion having an aperture therein through which the lock bolt passes and apertures therein through which pass fastening means fastening the portion to the said door vertical edge, the portion providing at least one respective connecting lock pin receiving passage projecting beyond the door outer face registering with the door closed with the said pin receiving passage of the strike plate portion; and a connecting lock pin inserted in the registered pin receiving passages of the said two portions connecting them together and thereby holding the door closed.

2. The combination claimed in claim 1, wherein the face plate portion provides two spaced lock pin receiving passages, and the strike plate portion provides a single lock pin receiving passage which is interposed between the said two spaced pin receiving passages of the face plate portion, the part of the strike plate portion providing the pin receiving passage also constituting the strike plate part of the strike plate portion that is engaged by the lock bolt as the door is closed.

* * * * *